United States Patent [19]

Nolin

[11] 4,418,552

[45] Dec. 6, 1983

[54] SIMULTANEOUSLY LOCKING AND UNLOCKING DEAD BOLT AND LOCK LATCH WITH PANIC UNLOCKING

[76] Inventor: Roger J. Nolin, 1838 Whitehurst Dr., Monterey Park, Calif. 91754

[21] Appl. No.: 279,590

[22] Filed: Jul. 1, 1981

Related U.S. Application Data

[63] Continuation-in-part of Ser. No. 86,945, Oct. 22, 1979, Pat. No. 4,276,760.

[51] Int. Cl.[3] ..... E05B 17/04; E05B 59/02; E05B 63/14; E05C 15/02

[52] U.S. Cl. ..... 70/107; 70/92; 70/110; 292/21; 292/34; 292/DIG. 65

[58] Field of Search ..... 70/107, 110, 92, 485, 70/484, 481; 292/21, 34, 92

[56] References Cited

U.S. PATENT DOCUMENTS

| | | | |
|---|---|---|---|
| 728,755 | 5/1903 | Patrick | 70/485 |
| 2,400,403 | 5/1946 | Falk | 70/481 X |
| 3,087,323 | 4/1963 | Foster | 70/92 |
| 3,159,994 | 12/1964 | Schulz | 70/484 |
| 3,390,558 | 7/1968 | Tornoe et al. | 70/107 |
| 3,563,585 | 2/1971 | Welch | 292/92 |
| 3,910,613 | 10/1975 | Nolin | 292/34 |
| 3,999,789 | 12/1976 | Maurits et al. | 292/34 |
| 4,011,741 | 3/1977 | Nolin | 70/107 |
| 4,156,541 | 5/1979 | Babb, Jr. et al. | 70/92 X |
| 4,183,563 | 1/1980 | Stevens | 292/34 |

*Primary Examiner*—Robert L. Wolfe

*Assistant Examiner*—Carl F. Pietruszka

*Attorney, Agent, or Firm*—Christie, Parker & Hale

[57] ABSTRACT

Extending a dead bolt into a locked position turns a crank that releases a lock release plate from an unlocked position which in turn releases a slide. Upon its release, the slide responds to springs and forces a tooth into a notch of an actuator to lock a latch bolt. To unlock the latch bolt and the dead bolt, the dead bolt can be directly retracted, whereupon the crank engages the lock release plate to move it back to its unlocked position. The lock release plate during this travel picks up the slide and withdraws the tooth from the actuator, freeing the latch bolt assembly. When locked, the latch bolt and the dead bolt can be simultaneously unlocked by rotation of an inside operator which produces rotation of a double-lobed cam. One lobe of the cam moves the slide against the force of the springs sufficiently to clear the tooth from the actuator. The cam continues to move the slide so that the slide engages the crank and rotates the crank to retract the dead bolt and force the crank into its unlocked position in a detent of the lock release plate. The force of the springs on the detent maintains the crank in its unlocked position. After the tooth clears the actuator, a dog on the cam picks up the actuator to rotate it and withdraw the latch bolt. For lever-actuated outside operators, the actuator has a finger engageable by the slide that in turn follows the rotation of the double-lobed cam. A lost motion space between the roller and the finger permits withdrawal of the tooth from a notch in the actuator prior to rotation of the actuator.

17 Claims, 6 Drawing Figures

FIG. 4
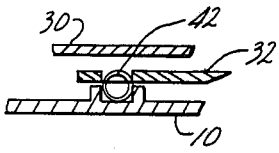
FIG. 3
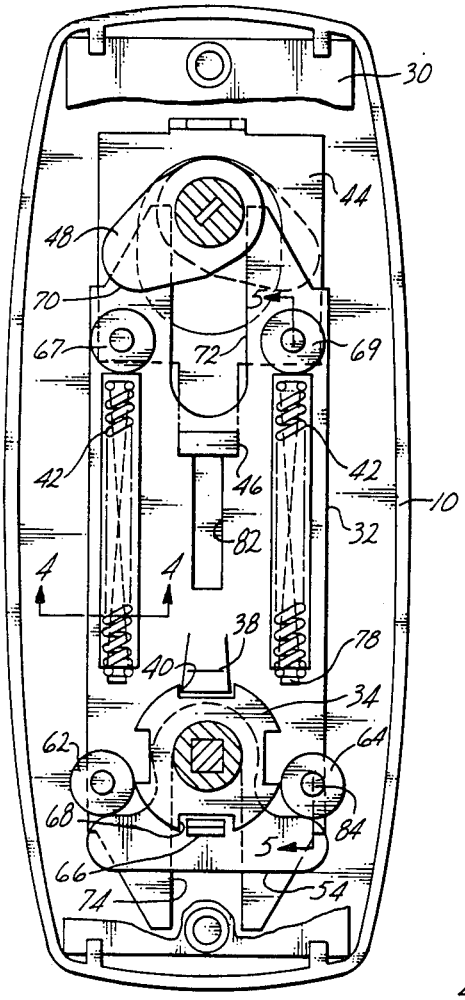
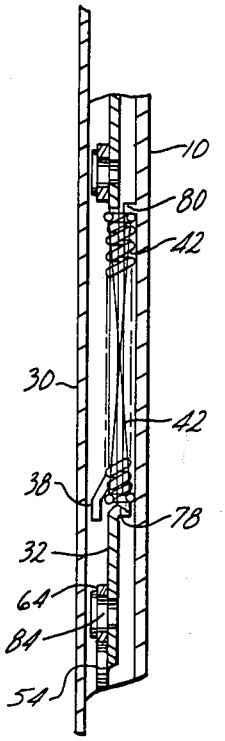
FIG. 5

SIMULTANEOUSLY LOCKING AND UNLOCKING DEAD BOLT AND LOCK LATCH WITH PANIC UNLOCKING

CROSS-REFERENCE TO RELATED APPLICATION

The present application is a continuation-in-part of application Ser. No. 086,945 filed Oct. 22, 1979, now U.S. Pat. No. 4,276,760, issued July 7, 1981.

BACKGROUND OF THE INVENTION

The present invention relates to locksets in general, and, more in particular, to double bolt locksets that simultaneously lock and unlock and have a panic unlock feature.

Locksets for locking doors against entry have taken a variety of forms. One form uses a key and a knob. This lockset has a spring-latch bolt biased to an extended position so that upon closing a door the latch extends into a mortise and keeps the door shut. The latch bolt can be locked to lock the door. The projection of the latch bolt, however, is short, leading to ease in springing the door or door jam and unwanted entry. In addition, this type of lockset generally is easily broken; for example, the knob can be pried off to expose the latch to easy retraction.

A second type of lockset is a mortise lock. These locks are considerably less vulnerable and are of much stronger construction than key-in-the-knob locks. These locks, too, have fallen into disfavor in recent years. One disadvantage is that a mortise lock requires a large cut-out space in the door to receive a large lock case that contains the lock mechanisms. The space in the door weakens the door. A good hard kick near the lock can often split the door and permit entry. Mortise locks are also expensive to install and to make.

A dead bolt lock is a third type of lockset. The dead bolt may be extended and retracted with a key from outside of a door and on the inside by an operator such as a thumb piece or thumb turn. A well-constructed dead bolt lock offers the best security of any of the locks discussed here. A dead bolt lock does not have the large cut-out space required by a mortise lock, and can project a substantial amount into a deep hole of an associated mortise in the door jam. One problem with dead bolts is that they require a spring latch bolt to retain the door closed when the dead bolt is retracted and the door unlocked. Operating both the dead bolt and the spring latch can be awkward.

Notwithstanding this defect in dead bolts, it has been the trend in recent years to construct locksets by combining both a dead bolt and a spring latch bolt. Some of these constructions have only the dead bolt locking. Others lock both the dead bolt and the latch bolt.

There is substantial inconvenience in a double locking lockset in having to independently unlock both the latch bolt and a dead bolt. Some constructions employing both a dead bolt and a latch bolt simultaneously retract both the dead bolt and the latch bolt by actuation of a single inside operator, such as an inside knob.

U.S. Pat. No. 3,910,613 to Roger Nolin describes a very simple lock that permits the simultaneous opening of a spring latch and a dead bolt in a surface-mounted lockset. But the patent does not describe a simultaneously locking and unlocking latch bolt and dead bolt.

Simultaneous locking and unlocking locksets are shown in mortise-type locks, such as in U.S. Pat. No. 3,337,248 to Fred J. Russell and Roger J. Nolin. In mortise-type locks, all the components, the dead bolt mechanisms, latch bolt mechanisms, key mechanisms, and retracting mechanisms, are located in the same case in close proximity to each other. Accordingly, it is comparatively easy to arrange the components at will to achieve the dependence necessary for simultaneous operation. Even with the attraction of mortise-type locks and the ability to simultaneously lock and unlock both the dead bolt and a latch bolt, these locks still offer poor security, and have the disadvantage of high installation and construction costs.

It is also a highly desirable feature in a lockset to provide for a panic-proof exit—to leave in a hurry in case of fire, for example. This type of lockset retracts both the lock bolt and latch bolt with a single operation of a hand operator on the inside of the door. U.S. Pat. No. 3,910,613, referenced above, is an example of such a panic-proof lockset.

U.S. Pat. No. 3,791,180 to William J. Doyle illustrates a different construction of a panic-proof feature in a surface-mounted lockset. This construction uses a gear sector to interconnect dead bolt and latch bolt assemblies. The construction has separately keyed lock bolts and latch bolts. Doyle does not provide for simultaneous locking and unlocking of both a dead bolt and a latch bolt with but a single operation from either inside or outside of a door.

U.S. Pat. No. 4,183,563 to Stevens discloses a panic-proof lockset that employs a double-lobed cam operatively connected to an inside hand operator and which couples to a slide to effect withdrawal of a dead bolt upon actuation of an inside hand operator. The slide is loaded in tension against the double lobes of the cam to maintain position. A shoulder of the slide bears on a crank of the dead bolt assembly. Rotation of the double-lobed cam in either direction displaces the slide downwardly and rotates the crank to withdraw the dead bolt. A slot in the slide receives the crank in the dead bolt's withdrawn position. The Stevens patent does not disclose means for simultaneously locking and unlocking a lockset in addition to a panic-proof feature.

U.S. Pat. No. 3,390,558 to Tornoe et al shows a complicated lock having many desirable features. It is panic-proof and has a latch bolt and dead bolt that can be simultaneously opened from either the inside or the outside of a door. This construction, however, does not provide a lockset that has a latch bolt and a dead bolt that simultaneously lock or unlock. The latch bolt is independently locked with a push turn button on the face of the inside knob. Turning the outside key retracts the dead bolt and the latch bolt, but the latch bolt remains locked. The control of the knob face has to be manually operated to unlock the latch bolt.

The parent of this application describes a lockset of a dead bolt and a spring latch bolt that simultaneously lock and unlock, and has a panic-proof feature. A crank mounts on a dead bolt assembly. During locking, the crank rotates and engages a slide that moves to engage a latch actuator with a tooth to lock the latch bolt. Springs bias the slide in a direction out of engagement with the actuator so that rotation of the crank away from the slide frees the slide, and it moves out of engagement with the actuator to unlock the latch bolt. Because the latch actuator must rotate to unlock the latch bolt and because it must be unlocked before rotation of the inside hand operator can open the latch bolt, lost motion is necessary between the inside hand operator and the actuator. To this end and to open the dead bolt, a retractor carries the slide and the springs that bias the slide away from engagement with the actuator. The retractor is spring biased towards the latch bolt assembly. The inside hand operator operates a cam that engages the retractor to produce translation of the retractor against the bias. With this movement of the retractor, the slide moves away from the actuator, and rotates the crank of the dead bolt assembly from its locked to its unlocked position. Retractor movement during this unlocking effects withdrawal of the tooth of the slide from the actuator prior to rotation of the actuator by a dog of the cam acting on a follower of the actuator: the lost motion. With rotation of the actuator, the latch bolt retracts.

SUMMARY OF THE INVENTION

The present invention provides a lockset that has both a latch bolt and a lock bolt. Both bolts can simultaneously be locked and unlocked. A panic-proof feature unlocks both the latch bolt and the lock bolt with a single operation of an inside hand operator.

In one form, the present invention provides a standard latch bolt assembly and a standard dead bolt assembly, both mounted on a case or escutcheon. An outside hand operator is directly connected to the latch bolt so that working the hand operator opens the latch bolt. An actuator fixed to the latch bolt drive can be locked to lock the latch bolt, and couples an inside hand operator to the latch bolt. A slide is biased towards the actuator. The actuator and the slide have means for mutual engagement to prevent rotation of the actuator and produce the lock of the latch bolt. A lock release coupled to the slide moves the slide and unlocks the actuator upon rotation of a crank mounted to the dead bolt assembly. The crank rotates upon unlocking of the dead bolt, and the dead bolt and latch bolt unlock together. Upon locking the dead bolt, the crank frees the lock release and the slide; the slide thereupon locks the actuator. To effect a panic exit, a cam rotates upon operation of an inside hand operator of the latch bolt assembly and engages the slide to move it and unlock the actuator. Thereafter the cam engages the actuator to open the latch bolt. The cam, in such movement, also translates the slide to rotate the crank into its unlocked position.

One form of the invention is adapted for use with outside hand operators employing a thumb-actuated latch. In this version, the actuator has a finger acted on directly by the slide after disengagement of the lock between the slide and the actuator.

In preferred form, the present invention contemplates an escutcheon that mounts a standard latch bolt and dead bolt assembly. An actuator is secured to a spindle of the latch bolt assembly that works directly by an outside hand operator of that assembly. The actuator has a notch for receipt of a tooth of a slide. When the tooth is in the notch, the actuator is locked against rotation. The actuator also has a notch that receives a dog of a cam. After some rotation of the cam, the dog picks up the actuator and rotates to open the latch bolt. The rotation of the cam before engaging the actuator translates the slide and withdraws the tooth from the notch. The slide is biased by a pair of springs towards a position with the tooth of the slide in engagement with the notch of the actuator. A pair of followers, in the form of rollers mounted on the slide, engage the lobes of a double-lobed cam in a locked position. Rotation of the cam translates the slide through engagement of one or the other of the rollers. The cam is secured to the inside hand operator of the latch bolt assembly. A lock release plate couples to the slide through a depending dog of the plate received in a longitudinal slot of the slide. The dog picks up the slide upon movement of the lock release plate in response to rotation of a crank towards the unlocked position and pulls the tooth out of the notch. The lock release plate has a follower that responds to rotation of the crank towards its unlocked position to move the plate. A detent of this follower locates the crank in its unlocked position by applying a force to either side of the crank that effects a balanced couple around the crank's axis of rotation. Upper followers of the slide act on the crank when the double-lobed cam moves the slide to move the crank into its unlocked position.

These and other features, aspects, and advantages of the present invention will become more apparent from the following description, appended claims, and drawings.

BRIEF DESCRIPTION OF THE DRAWINGS

FIG. 3 is a view similar to FIG. 2, but with the lockset in a locked position;

FIG. 4 is a view taken in a plane 4—4 of FIG. 3 showing the relationship between the escutcheon, springs, and slide;

FIG. 5 is a view taken in the plane 5—5 of FIG. 3 illustrating the relationship between the escutcheon, springs, and slide.

DESCRIPTION OF THE PREFERRED EMBODIMENTS

Figure 1:
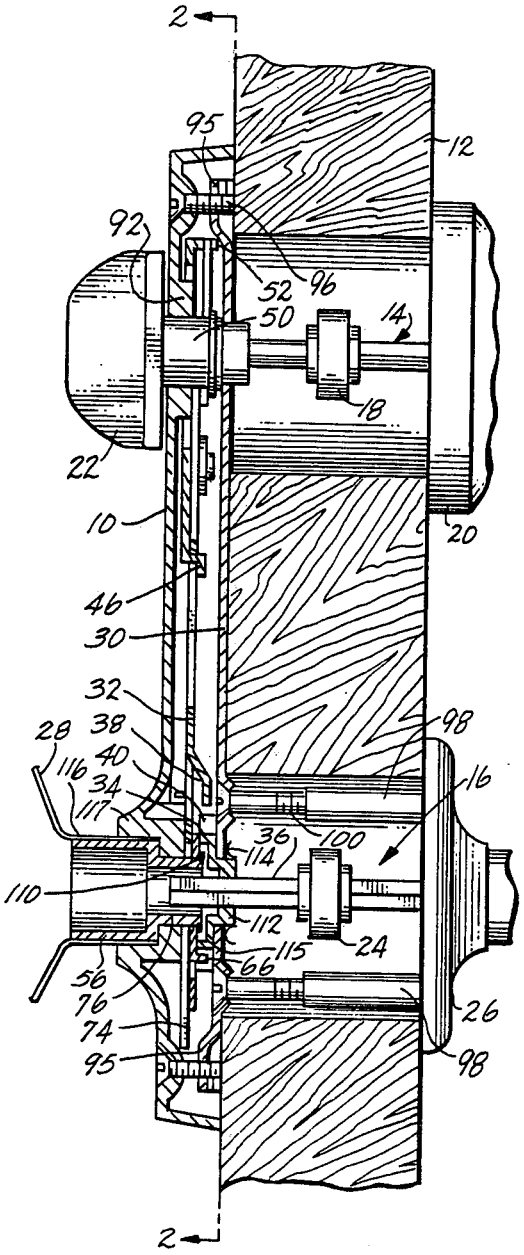
FIG. 1 is a side elevational view, mostly in half section, of a preferred embodiment of the present invention, taken in the plane 1—1 of FIG. 2.
Figure 2:
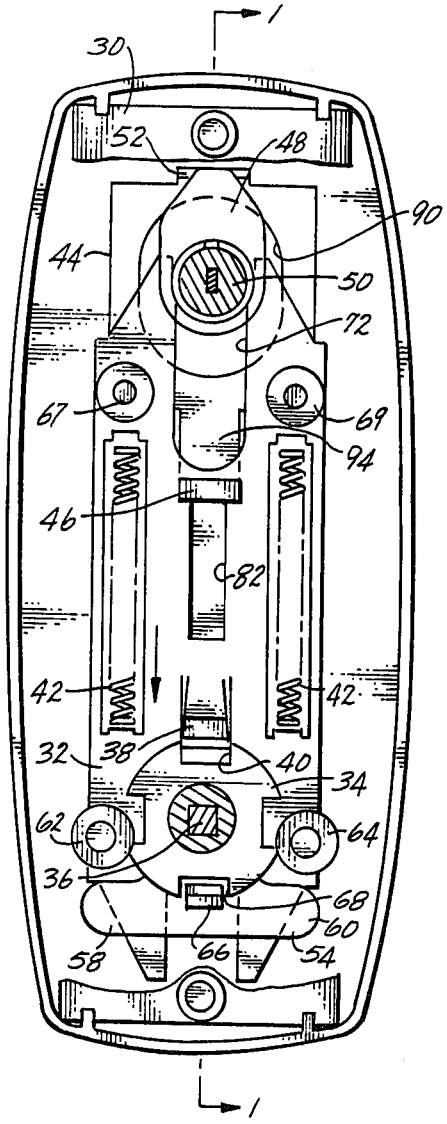
FIG. 2 is an elevational view taken in the plane of 2—2 in FIG. 1 looking toward the inside cover of the lockset, with a base plate shown only partially and the lockset in an unlocked position.

FIGS. 1 through 5 show one of the two preferred embodiments of the present invention. An escutcheon or case 10 is adapted to mount on a door 12. A dead bolt assembly 14 mounts on the escutcheon. A latch bolt assembly 16 also mounts on the escutcheon. The dead bolt assembly includes a dead bolt 18, an outside hand operator 20, and an inside hand operator 22. Operation of either the inside or the outside operator effects extension or retraction of the dead bolt in a known manner. Latch bolt assembly 16 includes a latch bolt 24, an outside hand operator 26, and an inside hand operator 28. Operation of either the inside or outside hand operator effects extension or retraction of the latch bolt in a known manner.

The present invention effects simultaneous locking of both dead bolt 18 and latch bolt 24, simultaneous unlocking of both bolts from either the inside or the outside hand operators of the dead bolt assembly, and simultaneous unlocking of both bolts from the inside hand operator of the latch bolt.

A base plate 30 mounts escutcheon 10. A slide 32 within the escutcheon is capable of vertical travel. An actuator 34 is secured to a spindle 36 of the latch bolt assembly to turn with that assembly in response to operation of outside operator 26. Slide 32 has a depending tooth or dog 38 that is capable of receipt in a notch 40 of the actuator to lock the actuator and the latch bolt. A pair of springs 42 bias slide 32 towards latch bolt assembly 16, towards a position with tooth 38 in engagement with notch 40. A lock release plate 44 within the escutcheon couples to slide 32 through a depending dog 46. A crank 48 mounted on a rotatable cylinder 50 of inside operator 22 is capable of engaging follower ears 52 of the lock release plate to raise the plate, engage slide 32 with dog 46, raise the slide, and withdraw tooth 38 from notch 40.

A double-lobed cam 54 is secured to a barrel 56 of inside operator 28 to rotate with the operator. The cam has a pair of lobes 58 and 60 for engaging followers 62 and 64 of the slide. Cam 54 has a dog 66 received in a notch 68 of actuator 34. A clearance space between dog 66 and the walls of notch 68 provide for lost motion between cam 54 and the actuator to permit upward movement of slide 32 and the clearing of tooth 38 from notch 40 prior to engagement of the cam dog with the actuator to effect retraction of the latch bolt.

A pair of upper rollers 67 and 69 mounted on slide 32 are positioned to engage crank 48 and rotate it from a locked position to an unlocked position. Crank 48 has a follower surface 70 for engagement by these rollers.

In FIG. 3, the arrangement under discussion is shown in a locked position with crank 48 rotated down towards actuator 34. Tooth 38 in notch 40 prevents rotation of actuator 34 and locks the latch bolt in place. Rotation of cam 54 by inside operator 28 lifts slide 32 through either of the rollers 62 or 64. As slide 32 moves upwardly, either of rollers 67 or 69 engage crank 48, in FIG. 3 roller 67. Roller 67 rotates crank 48 clockwise in FIG. 3 by engaging surface 70 of the crank until the crank reaches the position in FIG. 2, where it is captured by detent 52.

Thus, operation of either inside operator 22 or outside operator 20 of the dead bolt assembly from an unlocked to a locked position rotates crank 48 and frees lock release plate 44 from the influence of the crank. At the same time, dead bolt 18 extends. At this time, slide 32 responds to springs 42 to engage actuator 34 with tooth 38. The latch bolt is already extended. The latch bolt and dead bolt are then both locked. Unlocking by either the inside operator 22 or outside operator 20 of the dead bolt assembly brings crank 48 back into the FIG. 2 position. In getting to that position the crank moves lock release plate 44 upwardly. Dog 46 engages slide 32 and moves it upwardly, clearing tooth 38 from notch 40 of actuator 34. In the unlocked position, latch bolt 24 can be withdrawn in a standard manner to permit passage through the door. When locked, unlocking results from turning the inside operator 28 of the latch bolt assembly in either direction by cam 54 first moving slide 32 upwardly by engagement with either of the followers 62 or 64 for tooth 38 to clear out of notch 40 and then having dog 66 engage the actuator to rotate the actuator and retract the latch bolt. Continued upward movement of the slide in response to turning of the cam brings either of upper rollers 67 or 69 into engagement with crank 48 and the rotation of the crank into the unlocked position of FIG. 2.

This embodiment will now be discussed in greater detail. Slide 32 is generally planar. It has an upper slot 72 open at its top to receive cylinder 50 of dead bolt assembly 14. The walls of slot 72 guide on cylinder 50 and constrains the top of the slide in the plane of FIGS. 2 and 3 to move along the axis of the slide. A similar arrangement exists at the bottom of the slide. A slot 74 receives a reduced diameter portion 76 of barrel 56 of inside operator 28 of the latch bolt assembly. The walls of the slot track on this reduced diameter portion of the barrel to maintain the position of the slide along its longitudinal axis. As can be seen in FIG. 5, slide 32 has a boss 78 extending generally at right angles to the plane of the slide towards the top of escutcheon 10. This boss provides bearing for one of the springs 42, and one of the bosses exists on each side of the longitudinal axis of the slide for both springs. A complementary boss 80 of escutcheon 10 provides bearing for the upper end of one of the springs 42 on the escutcheon. A second identical boss to boss 80 provides bearing for the other spring. A slot 82 in slide 32 receives dog 46 of lock release plate 44 and permits movement of slide 32 independently of locking plate 30 when crank 48 of dead bolt assembly 18 is in its unlocked position. When cam 54 rotates to move slide 32 upward, dog 46 will move downward in slot 82. As the crank rotates from its locked to its unlocked position in response to upward movement of slide 32, the crank ultimately picks up lock release plate 44 by engaging follower 52 and moves the plate and its dog 46 upward relative to slide 32 into the position illustrated in FIG. 2. When the slide is released from the influence of cam 54, springs 42 move it downward so that dog 46 can move upward in slot 82 to engage the upper surface of the slot and capture the slide. Roller 64 mounts to slide 32 through a rivet 84. A similar staking arrangement mounts the balance of the rollers to the slide.

Lock release plate 44 is also generally planar. It has an oval-shaped hole 90 to pass the dead bolt assembly and a boss 92 of the escutcheon to permit the required vertical travel of the lock release plate. The plate has a depending finger 94 to dog 46. Dog 46 extends generally at right angles to the plane of the lock release plate and finger 94 through slot 82. Dog 46 also overlies the surface of slide 32 proximate slot 82 to locate the lock release plate at its lower end and constrain it except for movement along the longitudinal axis of the slide. The release plate is constrained at its upper end by engagement with the lateral surface of boss 92.

Follower ears 52 extend generally at right angles from the plane of lock release plate away from the upper surface of escutcheon 10 towards plate 30. Ears 52 are placed for engagement by the tip of crank 48. In the unlocked position, the ears impose downward forces on the crank from springs 42 that tend to center the crank in the unlocked position with a balanced couple about the axis of rotation of cylinder 50; these forces produce a stable position of the crank in the unlocked position.

Base plate 30 is also generally planar. It has internally threaded mounting lugs 95 to receive mounting screws 96. Screws 96 bear on the top of escutcheon 10 in recesses and hold the escutcheon to the base plate. Latch assembly 16 includes internally threaded bosses 98 of the outside door operator 26. Screws 100 bearing on base plate 30 attach the outside operator to the base plate, and the base plate and outside operator to door 12. A similar arrangement exists for attaching outside operator 20 to base plate 30 and mounting the upper portion of the lockset to the door, but the screws and bosses are at 90° to those of the latch bolt assembly and, therefore, are not shown.

Inside hand operator 28 mounts a lock clip 110 in an annular groove close to the end of reduced diameter portion 76 of barrel 56. This clip locates cam 54 on the barrel. A tongue of the cam in a groove on the barrel can couple the cam to the barrel for rotation with it. The cam also is located by bearing against a surface of slide 32. Actuator 34 is located on spindle 36 by engagement of a hub 112 of the actuator with the spindle; the hub has a square-in-cross-section hole that receives the spindle. A lock clip 114 frictionally engages the outer surface of hub 112 and bears against an inner surface of mounting plate 30 to axially locate the actuator on the spindle. The actuator is recessed at 115 to receive the end of reduced diameter portion 76 of barrel 56 and clip 110. A hub 117 of escutcheon 10 receives barrel 56 and a neck 116 of hand operator 28.

Figure 6:
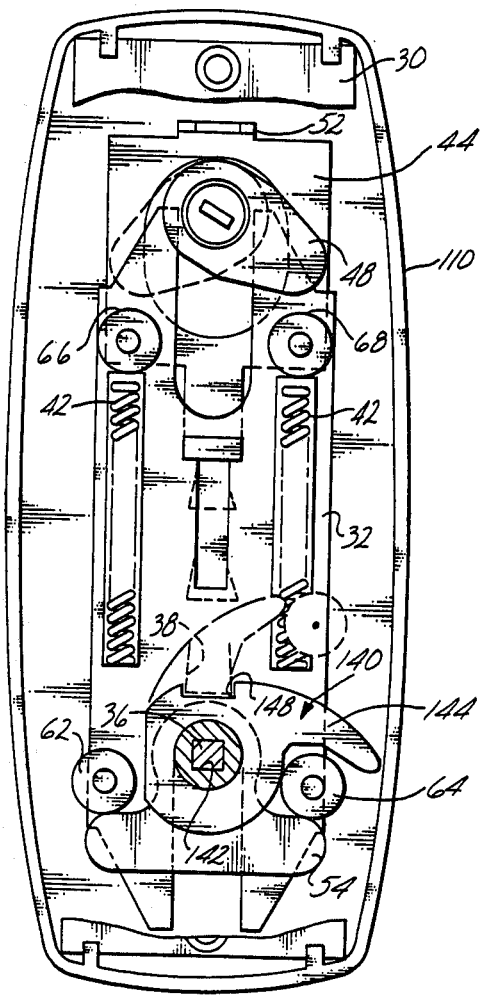
FIG. 6 is a view similar to FIGS. 2 and 3 but with a different actuator adapted for use with thumb-actuated outside hand operators.

In FIG. 6, the second of the preferred embodiments is described. This embodiment is useful for outside spring latch bolt operators that are actuated by a thumb piece lever. The embodiment contains many of the same parts as in the previously described one; therefore their identity and operation will not be described in detail, except as necessary to understand what is new in the Figure. An actuator 140 is received on spindle 36 through a square-in-cross-section hole 142. Actuator 140 has a finger 144 spaced from roller 64 of slide 32. The actuator has a notch 148 for receiving tooth 38 of the slide. Rotation of the inside operator rotates cam 54 to apply a force to one of the rollers 64 or 62. Slide 32 responds to this force and moves upwardly a distance for tooth 38 to clear notch 148; this is the lost motion distance. Continued rotation of the cam translates slide 32 upward for the engagement of crank 48 by either of the rollers 67 or 69 in the manner described.

FIG. 6 shows the various positions of the tooth, depending on what is happening to the lockset. In the lowest position the tooth engages notch 148 of actuator 140; the latch bolt is then locked. The upper position corresponds to the maximum displacement of slide 32 in its response to the inside hand operator. The intermediate position between these two extremes corresponds to the position of the tooth when either the thumb turn or the key cylinder 20 is actuated to unlock the dead bolt assembly, with crank 48 captured by detent 52.

The present invention has been described with reference to certain preferred embodiments. The spirit and scope of the appended claims should not, however, necessarily be limited to the foregoing description.

What is claimed is:

1. An improvement in a lockset of the type having an escutcheon mounting a dead bolt assembly and a latch bolt assembly, the dead bolt assembly having inside and outside operators to extend and retract the dead bolt through a dead bolt drive upon locking and unlocking either of the dead bolt operators, the latch bolt assembly having inside and outside operators to extend and retract the latch bolt through a latch bolt drive upon operation of either of the latch bolt operators, the improvement comprising:

(a) a slide mounted in the escutcheon for movement towards and away from the dead bolt assembly and with such movement away and toward the latch bolt assembly between a first position of the slide and a second position of the slide, respectively;

(b) means to bias the slide towards its first position proximate the latch bolt assembly and remote from the dead bolt assembly;

(c) a lock release mounted in the escutcheon for movement between a first position of the lock release and a second position of the lock release, respectively;

(d) crank means coupled to the dead bolt assembly for rotation between a crank locked position and a crank unlocked position, corresponding to a locked dead bolt and an unlocked dead bolt, respectively, the crank means during its movement from its locked to its unlocked position engaging the lock release and moving the lock release to its first position from its second position, the crank means in its unlocked position maintaining the lock release in its first position;

(e) means of the lock release to engage the slide and move the slide to its first position during movement of the lock release from its second position to its first position in response to rotation of the crank means between its locked position and its unlocked position, such means thereafter maintaining the slide in its first position;

(f) a latch actuator in the escutcheon and secured to the latch bolt drive for rotation therewith, the inside operator of the latch bolt drive being engageable with the actuator to rotate it and open the latch bolt;

(g) means for locking the slide and the latch actuator against relative rotation when the slide is in its second position and in response to the bias means; and (h) cam means on the inside operator of the latch bolt assembly engageable with the slide to move the slide and release the lock means and move the crank means to its unlocked position upon rotation of the inside operator.

2. The improvement claimed in claim 1 wherein:

the lock release includes a lock release plate and including a follower engageable by the crank for the movement of the lock release between its second and its first positions.

3. The improvement claimed in claim 2 wherein:

the means of the lock release to engage the slide includes a dog of the lock release, the slide having a slot in receipt of the dog to permit slide movement independently of the dog, the dog engaging the slide to move the slide away from the actuator upon rotation of the crank from its unlocked to its locked position.

4. The improvement claimed in claim 3 wherein:

the slide has slots that guide the slide on the latch bolt and the dead bolt assemblies.

5. The improvement claimed in claim 4 wherein:

the lock means of the actuator and the slide include a notch of the actuator and a tooth of the slide, the tooth being engageable in the notch in the locked position of the dead bolt and the slide is in its second position to lock the latch bolt.

6. The improvement claimed in claim 5 wherein:

the cam means and the actuator have lost motion means to permit movement of the slide in response to the cam and the withdrawal of the tooth from the notch before rotation of the actuator.

7. The improvement claimed in claim 1 wherein:

the actuator includes a finger engageable by the slide after a predetermined amount of rotation of the cam, the means for locking the slide and the latch actuator includes tooth means and notch means of these members, the tooth means being engageable in the notch means to lock the slide and actuator together, the predetermined amount of rotation of the cam moving the slide sufficiently to disengage the tooth and the notch and permit rotation of the actuator.

8. The improvement claimed in claim 7 wherein:

the lock release includes a lock release plate and including a follower engageable by the crank for the movement of the lock release between its second and its first positions.

9. The improvement claimed in claim 8 wherein:

the means of the lock release to engage the slide includes a dog of the lock release, the slide having a slot in receipt of the dog to permit slide movement independengly of the dog, the dog engaging the slide to move the slide away from the actuator upon rotation of the crank from its unlocked to its locked position.

10. The improvement claimed in claim 9 wherein:

the lock means of the actuator and the slide include a notch of the actuator and a tooth of the slide, the tooth being engageable in the notch in the locked position of the dead bolt to lock the latch bolt.

11. In a double bolt lockset of the type that mounts on the surface of the door and which includes a dead bolt assembly and a latch bolt assembly, the dead bolt assembly including inside and outside operators to extend and retract the dead bolt through a dead bolt drive upon locking and unlocking either of the dead bolt operators, the latch bolt assembly having inside and outside operators to extend and retract the latch bolt through rotation of a latch bolt drive upon operation of either of the latch bolt operators, and an escutcheon mounting the inside operators of both the latch bolt and dead bolt and having means to mount the case to a door, an improvement which comprises:

(a) a lock release mounted in the escutcheon for translation towards and away from the dead bolt assembly and the latch bolt assembly between a locked position toward the latch bolt assembly and an unlocked position toward the dead bolt assembly;

(b) a slide mounted in the escutcheon for translation towards and away from the dead bolt assembly and the latch bolt assembly;

(c) means to bias the slide toward the latch bolt assembly and away from the dead bolt assembly;

(d) crank means coupled to the dead bolt assembly for rotation between a locked position and an unlocked position in engagement with the lock release, such positions corresponding to an unlocked dead bolt and a locked dead bolt, the crank means in rotating between the locked position and the unlocked position engaging the lock release and translating it to the lock release's unlocked position;

(e) a latch actuator secured to the latch bolt drive and located in the escutcheon in line with the slide;

(f) lock means for the slide and the latch actuator to lock the latch actuator against rotation upon engagement by the slide in response to the bias means permitted by movement of the lock release to its locked position;

(g) means coupling the lock release and the slide together such that upon movement of the lock release to its unlocked position the slide moves away from the latch actuator and unlocks the lock means;

(h) means coupled to the inside operator of the latch bolt assembly for moving the slide against the force of the biasing means and unlock the latch actuator and to move the crank means to its unlocked position upon operation of such operator;

whereby:

(i) upon locking of the dead bolt, the biasing means forces the slide into engagement with the latch actuator to lock the slide relative to the latch actuator with the lock means;

(ii) upon unlocking the dead bolt the crank means moves the lock release to its unlocked position which in turn moves the slide and unlocks the slide from the latch actuator; and simultaneous locking and unlocking of the dead bolt and latch bolt occur; and (iii) upon operation of the inside operator of the latch bolt assembly, when locked, both the latch bolt and dead bolt retract to open positions.

12. The improvement claimed in claim 11 wherein the latch bolt assembly is of the type that biases the latch bolt into an extended position, the actuator has a unique rotational position when the latch bolt is extended, and the lock means for the latch actuator and slide include a tooth and a notch which upon engagement of the tooth in the notch locks the actuator.

13. The improvement claimed in claim 12 wherein the means coupled to the inside operator of the latch bolt assembly for moving the retractor and the slide includes a cam attached to such operator, and including means coupling the cam to the actuator to produce retraction of the latch bolt after a predetermined amount of travel of the slide corresponding to disengagement of the tooth and the notch.

14. The improvement claimed in claim 13 wherein the cam is a double-lobed cam with one lobe on each side of the slide, and including followers on the slide engageable by each lobe of the cam to move the slide.

15. The improvement claimed in claim 14 including detent means acting on the crank means in its unlocked positions to apply a force thereto that tends to maintain the crank in the unlocked position.

16. The improvement claimed in claim 11 wherein:

the actuator includes a finger engageable by the slide after a predetermined amount of rotation of the cam, the means for locking the slide and the latch actuator includes tooth means and notch means of these members, the tooth means being engageable in the notch means to lock the slide and actuator together, the predetermined amount of rotation of the cam moving the slide sufficiently to disengage the tooth and the notch and permit rotation of the actuator.

17. The improvement claimed in claim 15 wherein:

the actuator includes a finger engageable by the slide after a predetermined amount of rotation of the cam, the means for locking the slide and the latch actuator includes tooth means and notch means of these members, the tooth means being engageable in the notch means to lock the slide and actuator together, the predetermined amount of rotation of the cam moving the slide sufficiently to disengage the tooth and the notch and permit rotation of the actuator.

* * * * *